US006845925B2

(12) United States Patent
Abe et al.

(10) Patent No.: US 6,845,925 B2
(45) Date of Patent: Jan. 25, 2005

(54) FUEL INJECTOR

(75) Inventors: Motoyuki Abe, Chiyoda (JP); Yoshio Okamoto, Minori (JP); Yuzo Kadomukai, Ishioka (JP); Makoto Yamakado, Tsuchiura (JP); Ayumu Miyajima, Narita (JP); Toru Ishikawa, Kitaibaraki (JP); Yasuo Namaizawa, Kashima (JP)

(73) Assignee: Hitachi, Ltd., Tokyo (JP)

( * ) Notice: Subject to any disclaimer, the term of this patent is extended or adjusted under 35 U.S.C. 154(b) by 179 days.

(21) Appl. No.: 09/989,068

(22) Filed: Nov. 21, 2001

(65) Prior Publication Data

US 2003/0094518 A1 May 22, 2003

(51) Int. Cl.[7] ..... F02M 61/00
(52) U.S. Cl. ..... 239/533.12
(58) Field of Search ..... 259/581.1, 581.2, 259/585.1, 585.2, 533.12, 533.4, 573.8, 533.2, 456

(56) References Cited

U.S. PATENT DOCUMENTS

| | | | | |
|---|---|---|---|---|
| 4,216,652 A | * | 8/1980 | Herman et al. | 60/748 |
| 4,336,839 A | * | 6/1982 | Wagner et al. | 166/59 |
| 4,576,338 A | | 3/1986 | Klomp | |
| 4,790,270 A | * | 12/1988 | McKay et al. | 123/73 C |
| 5,098,016 A | * | 3/1992 | Okamoto et al. | 239/5 |
| 6,206,304 B1 | * | 3/2001 | Koseki et al. | 239/533.12 |
| 6,216,665 B1 | * | 4/2001 | Okamoto et al. | 123/305 |
| 6,308,684 B1 | | 10/2001 | Konishi | |
| 6,341,592 B2 | * | 1/2002 | Okamoto et al. | 123/305 |
| 6,367,720 B1 | * | 4/2002 | Okamoto et al. | 239/585.1 |
| 6,453,872 B1 | * | 9/2002 | Miyajima et al. | 123/298 |
| 6,474,572 B1 | * | 11/2002 | Tsuchiya et al. | 239/585.1 |
| 6,543,419 B2 | * | 4/2003 | Okamoto et al. | 123/442 |
| 2001/0022170 A1 | | 9/2001 | Okamoto et al. | |

FOREIGN PATENT DOCUMENTS

| | | |
|---|---|---|
| DE | 3407545 A1 | 9/1985 |
| EP | 1 108 885 A2 | 6/2001 |
| JP | 08082270 | 3/1996 |
| JP | 1020638 A2 | 7/2000 |

OTHER PUBLICATIONS

EPO Search Report dated Sep. 03, 2003.

* cited by examiner

*Primary Examiner*—Michael Mar
*Assistant Examiner*—Thach H. Bui
(74) *Attorney, Agent, or Firm*—Antonelli, Terry, Stout & Kraus, LLP

(57) ABSTRACT

To produce a fuel spray that is asymmetrical in the flow rate distribution of a sprayed fuel in order to improve the homogeneity of air-fuel mixture density during the air intake stroke injection for homogeneous combustion in an in-cylinder injection engine, the exit portion of the fuel injection hole is provided with the wall surfaces 204*a*, 204*b*, 205*a*, and 205*b* that are parallel to the central axis of the injection hole. Also, the periphery of the injection hole is provided with a plurality of areas in which the flow of the fuel in the radial direction of the injection hole will be restrained, and an plurality of areas in which the flow of the fuel in the radial direction of the injection hole will not be restrained, and a different size is assigned to each non-restraint area.

9 Claims, 6 Drawing Sheets

FUEL INJECTOR

BACKGROUND OF THE INVENTION

The present invention relates to a fuel injector for use in an internal combustion engine.

Fuel injectors for use in an in-cylinder injection type engine include a device that is so designed as to ensure that, as set forth in Japanese Application Patent Laid-Open Publication No. Hei 11-159421, the marginal portions of the fuel injection hole exit form an oblique plane not transverse to the body axial line of the fuel injector, that the force for restraining the flow of the fuel in the radial direction of the injection hole changes in a circumferential direction, and that the reach of the fuel spray which has been injected from injection hole marginal portions having a small restraint force is long and the reach of the fuel spray which has been injected from injection hole marginal portions having a large restraint force is short. In this case, the spray is stabilized and the fuel is supplied in the direction of the ignition plug, with the result that the stability of stratified combustion is ensured.

In the injection of fuel for producing a homogeneous combustion, it is important for the injected fuel to be sufficiently mixed with air during the period up to ignition. To achieve this, therefore, there arises the need for the distribution of the flow rate to be adjustable between the fuel sprayed towards the ignition plug of the combustion chamber after being injected, and the fuel sprayed towards the piston.

The fuel injectors in prior art, however, are intended to improve combustion stability by making it easy for the fuel to reach the ignition plugs principally during stratified combustion, and no fuel injectors have been known heretofore that are designed so that the flow rate distribution ratio of the fuel injected and sprayed for the air intake stroke occurring during homogeneous combustion differs between fuel spraying towards the piston and fuel spraying towards the ignition plug.

SUMMARY OF THE INVENTION

The object of the present invention is to provide a fuel injector by which spraying patterns that are different in flow rate distribution ratio can be formed to accelerate the mixing of a sprayed fuel with air and thus to improve the stability of homogeneous combustion.

A difference between the flow rate distribution ratio of the fuel sprayed towards the pistons and that of the fuel sprayed towards the ignition plugs can be generated by providing, downstream with respect to and outside the injection hole of the fuel injector, a flow restraint means for restraining the flow of the fuel, which flow restraint means operates to restrain the flow of the fuel in at least two places so as to split the injected fuel into portions high in spraying density and portions low in spraying density and so as to generate a difference in quantity between the split portions high in spraying density.

The flow restraint means described above can be implemented by providing, almost parallel to the above-mentioned injection hole, a wall surface for restraining the flow of the fuel in its radial direction, or by providing, almost parallel to the central axis of the injection hole, a plurality of wall surfaces for limiting the flow of the injected fuel. The formation of these wall surfaces enables the creation of a plurality of restraint areas in which the flow of the fuel in radial direction or in its flow direction is to be restrained, and a plurality of release areas in which the fuel can flow in the radial direction.

In a fuel injector for use in an in-cylinder injection type internal-combustion engine, it becomes possible, by assigning a different size to the multiple release areas mentioned above, to form spraying patterns such that, during the spraying of the fuel injected from the injection hole, the density distribution of the sprayed fuel at a cross section transverse to the body axial line of the fuel injector concentrates in approximately two directions, and such that the spraying pattern of the fuel is set to ensure that the flow rate of the sprayed fuel in one of the two directions of concentration is greater than the flow rate of the fuel in the other direction.

As a result, according to the fuel injector of the present invention, spraying with a density distribution that is asymmetrical to the injection hole axis can be formed, and when this fuel injector is used in an in-cylinder type of internal-combustion engine, the flow rate distribution ratios of the fuel sprayed towards the ignition plug of the engine cylinder and the fuel sprayed towards the piston can be optimized according to a particular mixing ratio of the fuel and air.

DESCRIPTION OF THE INVENTION

Figure 1:
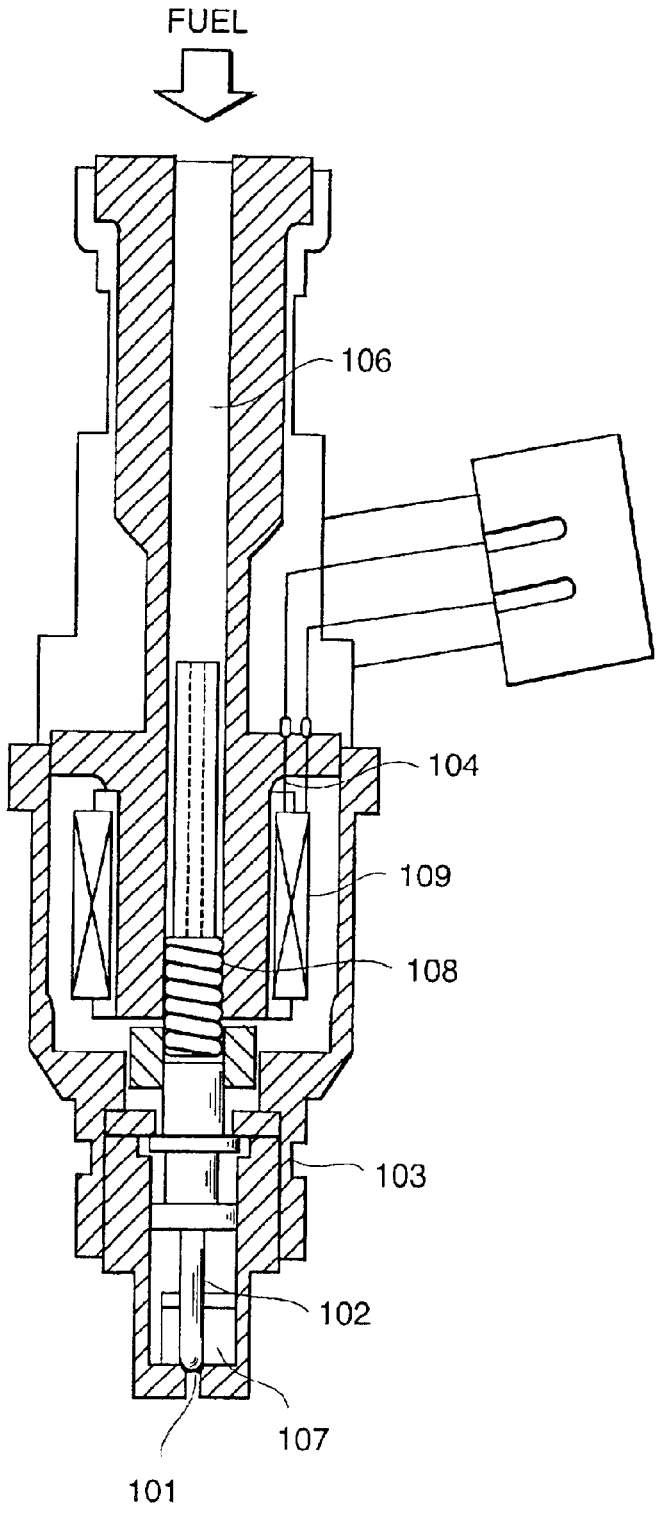
FIG. 1 is a longitudinal cross-sectional view showing an embodiment of the fuel injector pertaining to the present invention.

FIG. 1 is a cross-sectional view showing the structure of an embodiment of the fuel injector pertaining to the present invention. The fuel injector shown in FIG. 1 is a normally closed type of electromagnetic fuel injector, in which a valve body 102 and seat portion 202 are in firm contact when power is not supplied to a coil 109. Fuel is supplied from a fuel supply port under pressure determined by a fuel pump (not shown in the figure), so that the fuel passageway 106 of the fuel injector is filled with fuel up to the point where the valve body 102 and seat portion 202 are in firm contact. When power is supplied to coil 109 causing the valve body 102 to leave the seat portion, the fuel will be injected from injection hole 101. In this sequence, the fuel flows to injection hole 101 through a rotational groove provided in a rotating element 107. When the fuel flows through the rotational groove in rotating element 107, rotational force is assigned to the fuel to ensure that the fuel is rotationally injected from injection hole 101.

Figure 2:
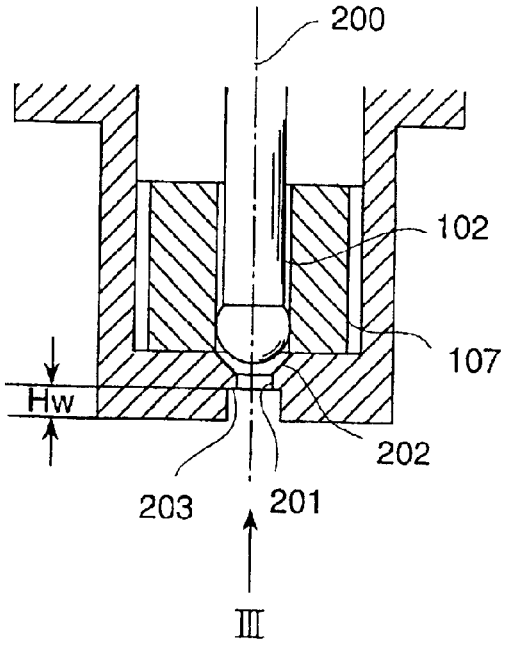
FIG. 2 is an enlarged longitudinal cross-sectional view in the neighborhood of the injection hole in the fuel injector pertaining to the present invention.
Figure 3:
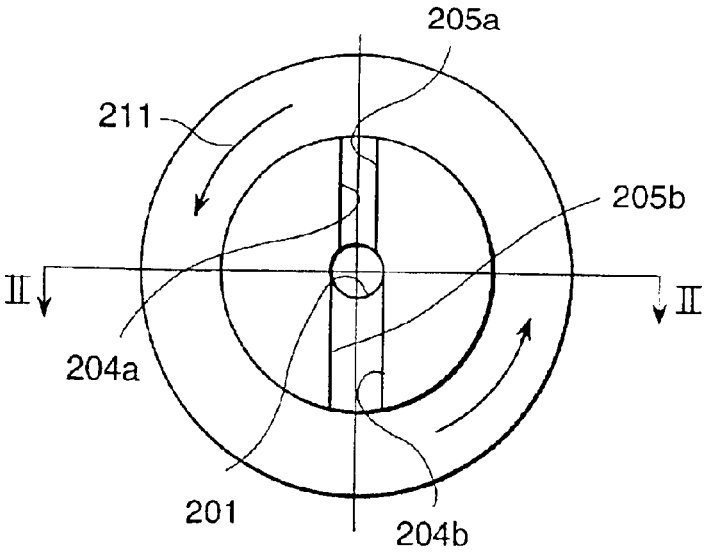
FIG. 3 is an end view in the neighborhood of the injection hole in the fuel injector, as seen from the direction of arrow III in FIG. 2.

FIG. 2 is a cross-sectional view showing in enlarged form the neighborhood of the open end of the injection hole in the fuel injector shown in FIG. 1, and FIG. 3 is an end view of the corresponding portion when seen from the direction of arrow III in FIG. 2. FIG. 2 also corresponds to a cross-sectional view as seen on the line II—II in FIG. 3. In addition, an injection hole central axis 200 coextensive with the center of injection hole 101 and running in the axial direction of the fuel injector (namely, the direction along the valve axis center) is shown with a single-dashed line in FIG. 2. The direction of the injection hole central axis 200 agrees with the driving direction of valve body 102. Furthermore, a first line segment passing through the center of injection hole 101 and running orthogonally with respect to injection hole central axis 200, and a second line segment passing through the center of injection hole 101 and running orthogonally with respect to injection hole central axis 200 and the first line segment are shown with a single-dashed line in FIG. 3.

On that plane vertical to the injection hole central axis 200 that is present at the open end of injection hole 101, a recess 203 is provided so as to overhang the open end of injection hole 101. Wall surfaces 204*a*, 204*b*, 205*a*, and 205*b* parallel to injection hole central axis 200 are formed at the open end of the injection hole by recess 203. The distance between wall surfaces 204*a* and 205*a* is set so as to be shorter than the distance between wall surfaces 204*b* and 205*b*.

Figure 4:
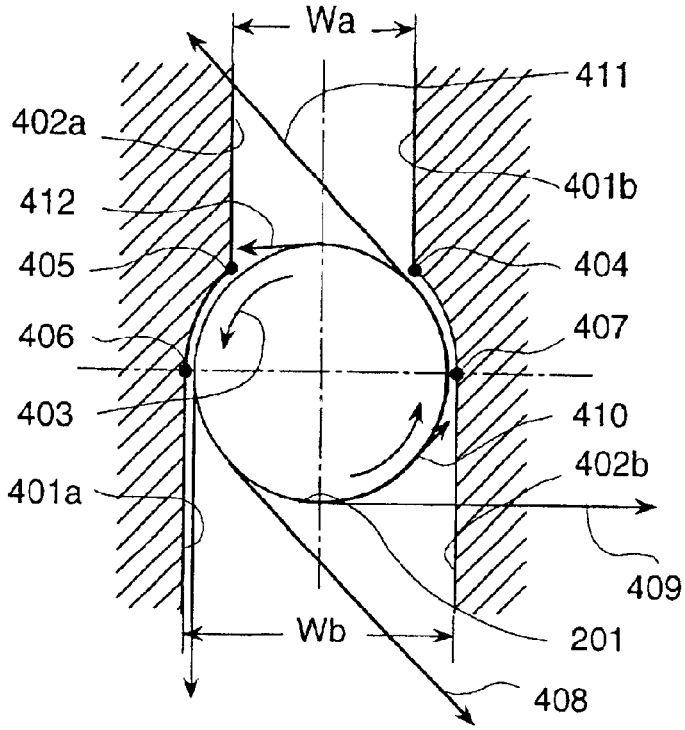
FIG. 4 is a diagram showing the neighborhood of the injection hole in FIG. 3 (cross-hatching denotes the bump portion in the frontal direction of the paper surface)

FIG. 4 is a further enlarged view of the injection hole open end shown in FIG. 3, and it is a view of the neighborhood of the injection hole, showing the way the fuel is injected from the injection hole. The cross-hatched portion in this view has the shape of a bump relative to recess 203.

The wall surface in the area from point 405 to point 406 and the wall surface in the area from point 407 to point 404 are provided outside the inner wall 201 of the injection hole in the radial direction thereof. This arrangement of wall surfaces enables the open end of the injection hole to be machined accurately and easily since, after the wall surfaces located in parallel with injection hole central axis 200, that are downstream with respect to injection hole 101, have been machined, when the injection hole is machined from the upstream end thereof using a punch or the like, members can be applied between the inner wall of the injection hole, the wall surface in the area from point 405 to point 406, and the wall surface in the area from point 407 to point 404.

The fuel injector shown in FIGS. 1 to 4 is an example of a swirl-type fuel injector in which the wall surfaces parallel to the injection hole central axis 200, shown in the areas from point 405 to point 406 and from point 407 to point 404, are provided downstream with respect to and outside of the injection hole as a means for restraining the radial flow of the fuel.

The fuel injector shown in FIGS. 1 to 4 is a swirl-type fuel injector in which the fuel is rotationally injected from injection hole 101. The pressure near the center of injection hole 101 is reduced by the rotation of the fuel, and the fuel rotates into a sheet or membrane form as it flows downward along the injection hole inner wall 201. Accordingly, the fuel is injected from the outer surface of the injection hole inner wall 201 with a velocity corresponding to a component in the tangential direction of inner wall 201 (namely, a component in the rotational direction of the fuel) and a velocity corresponding to a component in the downward direction of injection hole central axis 200. Arrow 403 in FIG. 4 signifies the rotational direction of the fuel, and arrows 408 to 412 denote the direction of fuel injection.

Of all wall surfaces parallel to injection hole central axis 200, only those existing in the areas from point 405 to 406 and from point 407 to point 404 act as restraint wall surfaces at which the flow of the fuel in the radial direction of the injection hole is restrained. Since the fuel continues rotating at these restraint wall surfaces, the quantity of fuel injection at the restraint wall surfaces decreases in comparison with the quantity of fuel injection in the area where the flow of the fuel in the radial direction of the injection hole is not restrained. When the walls are tall enough, in particular, almost no fuel is injected from the areas from point 405 to 406 and from point 407 to point 404.

The quantity of fuel injection at the restraint wall surfaces is determined by the ratio between the velocity of the fuel in its rotational direction and the velocity in the direction of the injection hole central axis, and the height of the restraint walls. For example, if the height of the restraint walls is greater than the distance through which the fuel flows in the direction of the injection hole central axis while rotating in the area from point 405 to point 406, almost no fuel is injected from the area from point 405 to 406.

In the areas from point 404 to point 405 and from point 406 to point 407, however, since the flow of the fuel in the radial direction of the injection hole is not restrained, a large portion of the fuel is injected from these areas.

Since the spread of the fuel spray after it has been injected is substantially determined by the size of the release areas in which the flow of the fuel in the radial direction of the injection hole is not restrained, the flow rates of the fuel injected from point 404 to point 405 and from point 406 to point 407 can be adjusted by varying the dimensional ratio of these areas.

Here, to ensure that the fuel that has been injected from the release areas mentioned above forms a uniform spraying pattern, it is desirable that the relationship in position between points 406 and 407, that determines the release area in which the flow rate of the fuel injected is greater, should be such that the angle in the area from point 406 to point 407, with injection hole central axis 200 as its center, is 180 degrees or greater. The reason for this is that, when the distances between points 405 and 406 and between points 407 and 404 in the restraint areas of flow of the fuel in the radial direction of the injection hole are long enough, since the quantities of fuel rotationally flowing out along these wall surfaces will increase and these quantities of fuel will flow out from the starting points of the release areas (namely, points 406 and 404), the density of the fuel flowing out from these points will increase and the density distribution of the sprayed fuel will tend to be non-uniform.

When the requirement is satisfied that the relationship in position between points 406 and 407, that determines the release area in which the flow rate of the fuel injected is greater, should be such that the angle in the area from point 406 to point 407, with injection hole central axis 200 as its center, is 180 degrees or greater, it becomes possible to reduce the circumferential length of the wall surfaces at which the fuel flows in the radial direction of the injection hole, to control the quantities of fuel flowing out from the starting points of the release areas (namely, points 404 and 406), and to achieve almost uniform spraying of the fuel injected from the release areas.

As described above, the fuel injected from points 406 and 404 acts to increase the spraying density, and it is known that the reach of the fuel spray after being injected becomes long at this section. If the reach of the fuel spray needs to be even longer according to the particular specifications of the engine, the section where these sprays of fuel concentrate can be intentionally created for partially increased reach of the fuel spray. In this case, the areas from point 405 to point 406 and from point 407 to point 404, that is to say, the areas where the flow of the fuel in the radial direction of the injection hole is restrained, should be extended or the height of the wall surfaces in these areas should be increased.

In the fuel injector shown in FIGS. 1 to 4, the uniformity of the fuel spray can be changed according to the particular size of the areas in which the flow of the fuel in the radial direction of the injection hole is released. When it is desirable that the fuel be particularly uniform, however, it is possible to split fuel spraying into approximately two directions by adopting a structure as shown in FIG. 5, and make the quantities of split fuel sprays different from each other, while at the same time making each split spray pattern uniform.

Figure 5:
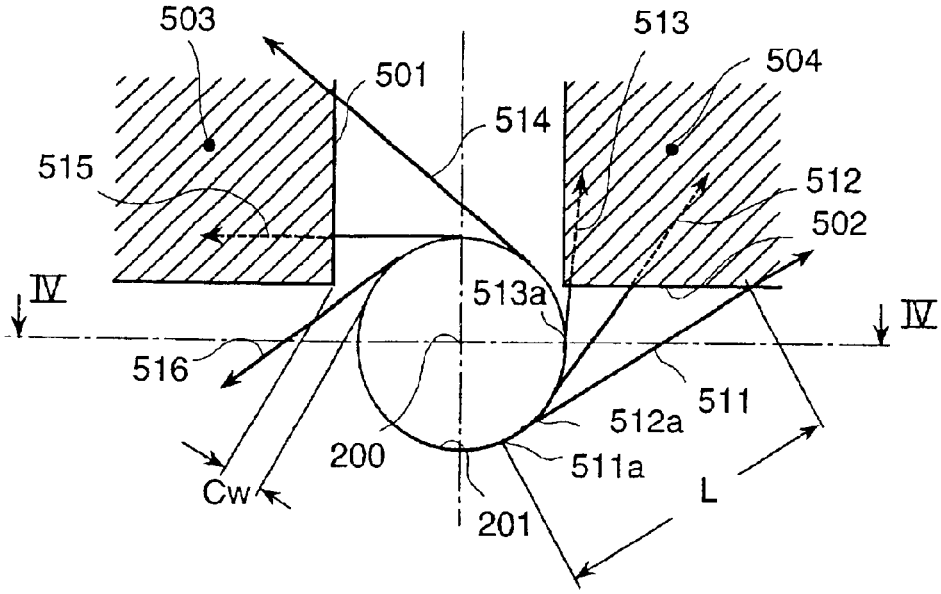
FIG. 5 is an enlarged diagrammatic view in the neighborhood of the injection hole according to another embodiment of the fuel injector having fuel flow restraint means as wall surfaces (cross-hatching denotes the bump portion in the frontal direction of the paper surface)

FIG. 5 shows an example in which wall surfaces 501 and 502 almost parallel to the central axis 200 of the injection hole are provided downstream with respect to and outside of this injection hole as fuel flow restraint means, and this figure is a front view of the fuel flow restraint means as seen from the open end of the injection hole. Wall surfaces 501 and 502 are provided at a point where they come into contact with the fuel after it has been injected following downward flow along injection hole inner wall 201.

The maximum value of the distance Cw between the injection hole inner wall 201 and the wall surface 501 that brings wall surface 501 and the injected fuel into contact is determined by the ratio between the velocity Vt of the fuel in its rotational direction and the velocity Va of the fuel in the direction of the injection hole central axis, and the height Hw of the restraint walls. In other words, Cw needs to be smaller than at least Hw×Vt/Va. The value of Vt/Va, which is the ratio between the velocity Vt of the fuel in its rotational direction and the velocity Va of the fuel in the direction of the injection hole central axis, can also be estimated from the spread angle θ of the fuel spray, and this relationship can be represented as $\tan\theta = Vt/Va$.

Figure 12:
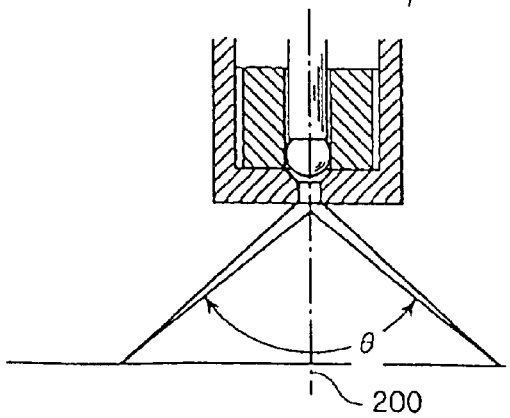
FIG. 12 is a cross-sectional view showing the spraying status of fuel.

Here, the spread angle θ of the fuel spray is the angle θ at which the fuel that has been injected from the injection hole spreads in the direction of departure from the central axis 200 of the injection hole. FIG. 12 is a cross-sectional view showing the way the fuel is injected from the open end of the injection hole as seen along line IV—IV in the fuel injector of FIG. 5. In actual operation, it is possible to photograph the cross section of the fuel spray as shown in FIG. 12, by radiating sheet-like light (such as a laser beam) onto the sprayed fuel so as to pass through the central axis 200 of the injection hole, and photographing the fuel spray pattern, thereby making it possible to measure the spread angle θ of the fuel spray.

In the fuel injector of FIG. 5, the fuel that flows downstream while rotating along the injection hole inner wall 201 is injected in the directions of arrows 511 to 516 at the open end of the injection hole. At this time, portions of the wall surfaces 501 and 502, functioning as a fuel flow restraint means, interfere with the injected fuel, with the result that the fuel does not splash in its intended direction.

The fuel that has been injected in the direction of arrow 511 in FIG. 5, for example, splashes without interference between the fuel and wall surface 502, since the distance L between the injection point 511*a* and the point of interception of arrow 511 with the wall surface 502 is sufficiently long. However, the fuel that has been injected in the directions of arrows 512 and 513 interferes with the wall surface 502 and does not splash in the intended direction, because the distance between injection points 512*a* and 513*a* and wall surface 502 is too short.

Likewise, the fuel in the direction of arrow 515 is intercepted by the wall surface 501 and does not splash in the intended direction.

Figure 7:
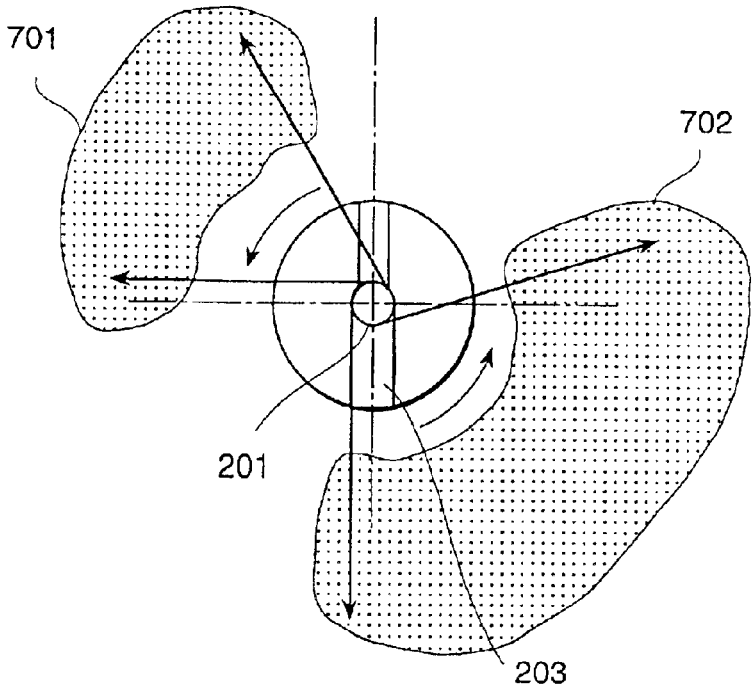
FIG. 7 is a cross-sectional view showing epitomically the spraying pattern obtained by using the fuel injector of the present invention.

In this way, the presence of wall surfaces 501 and 502 as a fuel flow restraint means causes an interference with the flow of the fuel, resulting in a distribution-of-spraying as shown in FIG. 7.

Figure 11:
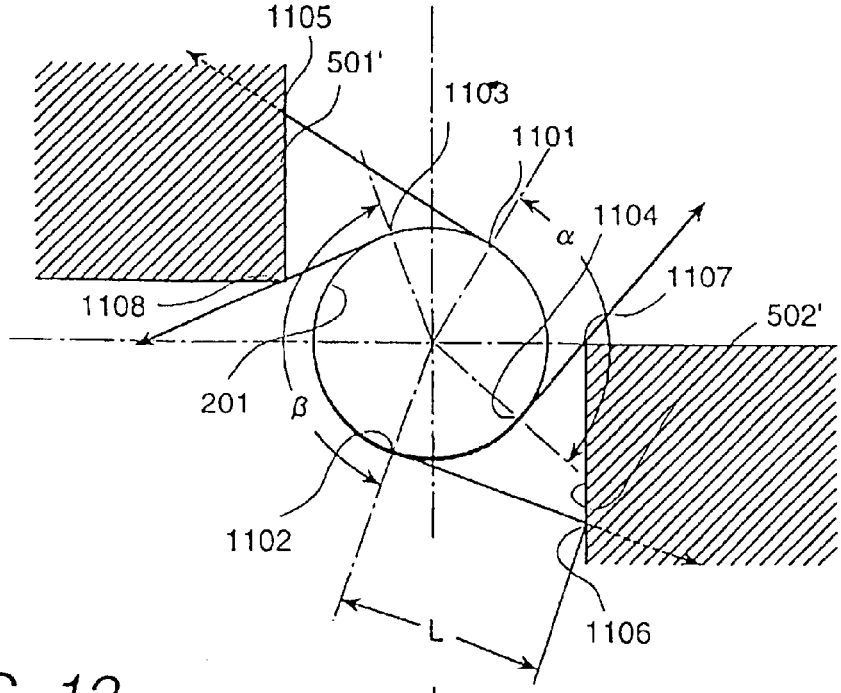
FIG. 11 is a diagrammatic view showing the neighborhood of the injection hole in an embodiment of a fuel injector having a function equivalent to that of the fuel injector shown in FIG. 5 (cross-hatching denotes the bump portion in the frontal direction of the paper surface)

Also, the shape of the injection hole open end as shown in FIG. 11 can be used to obtain results similar to those of FIG. 5. In FIG. 11, wall surfaces 501' and 502' parallel to the central axis of the injection hole are provided as a means for restraining the flow of the fuel after it has been injected. The areas where the flow of the fuel is restrained and the areas where the flow of the fuel is not restrained can be adjusted according to the particular relationship in position between the injection hole inner wall 201 and the wall surfaces 501' and 502'.

The fuel release areas α and β in FIG. 11 are determined by the distance L from the injection point of the fuel, the height Hw of wall surfaces 501' and 502', the velocity component Vt of the fuel in its rotational direction, and the velocity component Va of the fuel in the direction of the injection hole central axis.

The injection point 1102 on the injection hole inner wall 201, as shown in FIG. 11, is a point located exactly at the boundaries of the release areas and the restraint areas, and the fuel that has been injected from the injection points located in the direction of area ? from this point does not come to interfere with wall surface 502'. Injection point 1101 is also located at the boundary of a release area and a restraint area, and the fuel that has been injected from the injection points located in the direction of area a from this point is not interfered with by the wall surface 501'.

At these injection points located at the boundaries, the relationship in position between the wall surface and the injection point is determined by the distance L from the injection point of the fuel, the height Hw of wall surfaces 501' and 502', the velocity component Vt of the fuel in its rotational direction, and the velocity component Va of the fuel in the direction of the injection hole central axis, and this relationship can be represented as L=Hw×Vt/Va.

Injection points 1103 and 1104 are also points located at the boundaries of the release areas and the restraint areas. These injection points located at the boundaries become tangent points when a tangent line is drawn from the positions closest to the injection hole inner wall 201 among all points on the wall surfaces 501*a* and 502*a* (in FIG. 11, these positions are shown as points 1107 and 1108), to the injection hole inner wall.

In this way, the four boundaries between the release areas and the restraint areas can be adjusted according to the particular relationship in position between wall surface 501', wall surface 502', and the injection hole inner wall 201, and the particular height of wall surfaces 501' and 502'. As a result, the respective sizes of the release areas and the restraint areas can be adjusted. For example, increasing the height of wall surfaces 501' and 502' narrows the release areas. Conversely, distancing wall surfaces 501' and 502' from the injection hole inner wall broadens the release areas.

Figure 6:
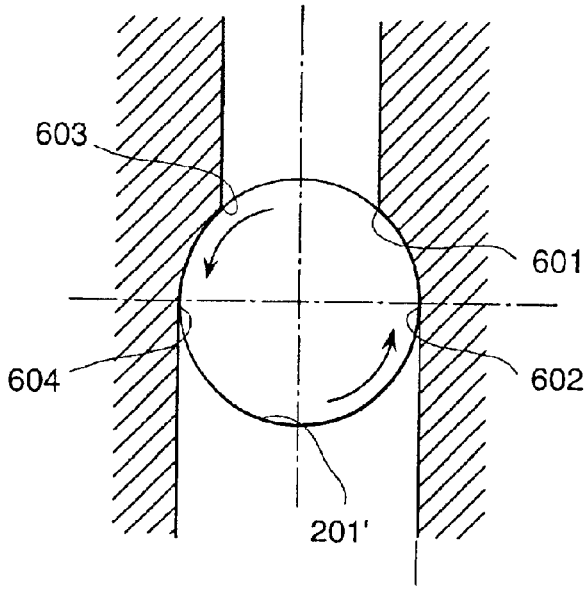
FIG. 6 is a diagram showing the neighborhood of the injection hole in the fuel injector shown in FIG. 4, and showing an embodiment in which the means for restraining the flow of fuel in a radial direction is provided as an extension to the injection hole (cross-hatching denotes the bump portion in the frontal direction of the paper surface)

FIG. 6 is a view of the open end of the fuel injector in which portions of the wall surfaces 205*b*, 205*a*, 204*a*, and 204*b* that are parallel to the injection hole central axis 200 in FIG. 2 come into contact with the injection hole inner wall and form a portion thereof. That is to say, in FIG. 6, the length of the injection hole inner wall 201' in the direction of the central axis 200 of the injection hole is different from the length of the injection hole in its circumferential direction. In the areas from point 601 to point 602 and from point 603 to point 604, the injection hole inner wall is longer as it goes in the direction of injection hole central axis 200 (that is to say, the longitudinal direction with respect to the paper surface of FIG. 6), and functions as a means for restraining the flow of the fuel in its radial direction. In the areas from point 601 to point 603 and from point 602 to point 604, the injection hole inner wall is shorter as it goes in the direction of injection hole central axis 200 and forms a release area in which the flow of the fuel in its radial direction is not restrained.

Here, the area from point 601 to point 603 serving as the release area, and the area from point 602 to point 604 differ in spread. More specifically, a plurality of areas at which the length of the injection hole inner wall 201' in the direction of the injection hole central axis 200 is short are provided in the circumferential direction of the injection hole to ensure that circumferential areas shorter in the length of injection hole inner wall 201' in the direction of injection hole central axis 200 differ from each other in spread.

The use of a fuel injector having a configuration as shown in FIG. 6 produces results similar to those obtained from the use of a fuel injector having an injection hole open end with a shape as shown in FIG. 3. Under such a configuration, the shape of the injection hole open end as shown in FIG. 6 can be easily obtained by carrying out cutting operations, near-net-shave plastic working operations, and/or the like, on a general fuel injector whose injection hole open end is not provided with any wall surfaces parallel to the injection hole central axis 200.

FIG. 7 is an epitomic view of the spraying pattern formed by the fuel which is injected by the fuel injector of FIGS. 1 to 6. This figure shows the spraying pattern as seen downstream with respect to the fuel injector, and this spraying pattern exhibits a cross section within a plane perpendicular to the central axis of the injection hole.

All fuel injectors shown in FIGS. 1 to 6 have a fuel flow restraint means, which restrains the flow of the fuel in at least two places, and since the sizes of the fuel flow restraint areas differ at each place, the distribution shape of the spray at a cross section perpendicular to the injection hole central axis 200 is split in approximately two directions (701 and 702), as shown in FIG. 7, and at the same time, the respective quantities-of-distribution and spreads of the spray take different shapes.

The distribution shape of the spray can be changed according to the particular spread of the release areas in which the flow of the fuel is not restrained.

More specifically, in the fuel injector of FIG. 4, the distribution shape of the spray can be changed by varying the height Hw (shown in FIG. 2) of the wall surfaces parallel to the injection hole central axis 200, and the respective widths (Wa and Wb in FIG. 4). For example, if height Hw of the wall surfaces is increased, the spread of the spray will be narrower since the effectiveness of the wall surfaces at which the flow of the fuel in its radial direction is to be restrained will increase for the fuel that rotationally flows. It is also possible, by varying Wa and Wb, to change the spread of the release areas at which the flow of the fuel in its radial direction is not to be restrained, and thereby to adjust the flow rate distribution of the approximately bi-directionally split sprays of fuel in the respective directions.

Figure 8:
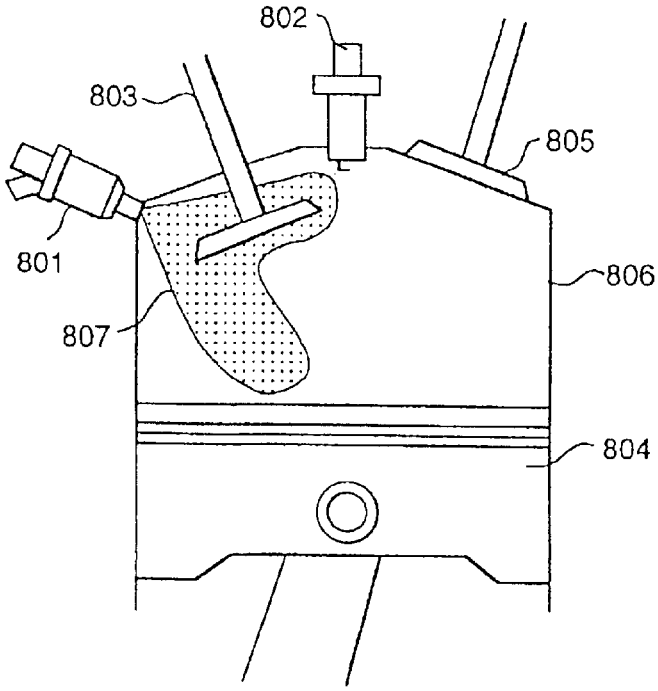
FIG. 8 is a cross-sectional view showing an embodiment in which the fuel injector pertaining to the present invention is mounted in the cylinder of an internal-combustion engine.

FIG. 8 is a cross-sectional view showing the internal situation of an engine cylinder existing when the fuel injector having the injection hole open end shown in FIGS. 1 to 5 is installed at the air intake valve end of an in-cylinder injection engine equipped with two intake valves and two exhaust valves and in which fuel was injected into the combustion chamber during the intake stroke. Since the injection is conducted during the intake stroke, intake valve 803 is in an open status during fuel injection. It is advisable that the fuel injector be installed so that, of the flow rate concentration portions of the spray during which the flow rate of the fuel concentrates in approximately two directions, only the portion smaller in flow rate flows towards the ignition plug 802 and the portion larger in flow rate flows towards the piston 804.

By installing the fuel injector in this way and injecting the fuel, since the spray is split in two directions, i.e., for the direction of piston 804 underneath intake valve 803 and the upward direction of intake valve 803, the fuel density distribution of the mixture inside the cylinder during ignition can be prevented from becoming too lean, or the fuel density distribution of the mixture at the side of piston 804 can be prevented from becoming too dense. If the fuel density near the ignition plug 802 is too low or too high, a misfire can result, namely, a failure in the firing of the mixture. Spraying fuel in the direction of ignition plug 802 is therefore effective for preventing a misfire and for suppressing reduced engine output and the emission of an unburned fuel.

The effectiveness described above can be obtained only by providing a fuel flow restraint means downstream with respect to the injection hole, and this is not limited to the shapes of the injection hole open ends shown as examples in FIGS. 3, 4, and 5. The above-described effectiveness can also be obtained in a fuel injector having the shapes of the injection hole open ends shown in, for example, FIGS. 9(*a*), 9(*b*) and 10. Even for the shapes of the injection hole open ends shown in FIGS. 9(*a*), 9(*b*) and 10, two areas in which the flow of the fuel in the radial direction of the injection hole is not restrained are provided in the circumferential direction of the injection hole, downstream with respect to the open end thereof, and these areas are provided so as to differ from one another in size. Because of this configuration, the distribution of the spray at a cross section perpendicular to the injection hole axis 200 of the injected spray of fuel concentrates in approximately two directions, and the spray can be set to a pattern in which one of the two sprays of fuel is larger in flow rate and the other is smaller in flow rate.

Figure 9A:
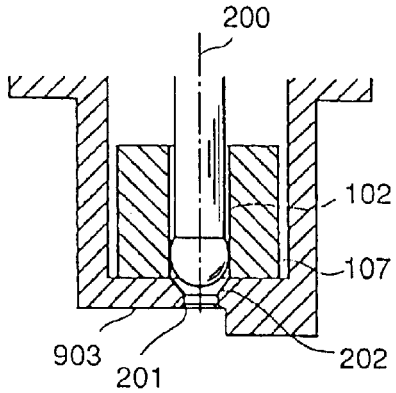
FIG. 9(*a*) is a cross-sectional view and FIG. 9(*b*) is a front view showing an embodiment of the fuel injector pertaining to the present invention.
Figure 9B:
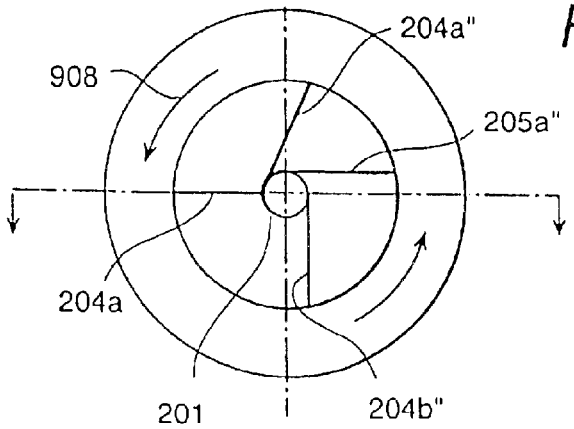

The shapes of the injection hole open ends shown in FIGS. 9(*a*), 9(*b*) and 10 are also effective in that, when the fuel injector is mounted in an in-cylinder injection engine, changes in the spraying direction and spraying density of the fuel due to the creation of deposits during the carbonization of the fuel and lubricants are reduced.

Figure 10:
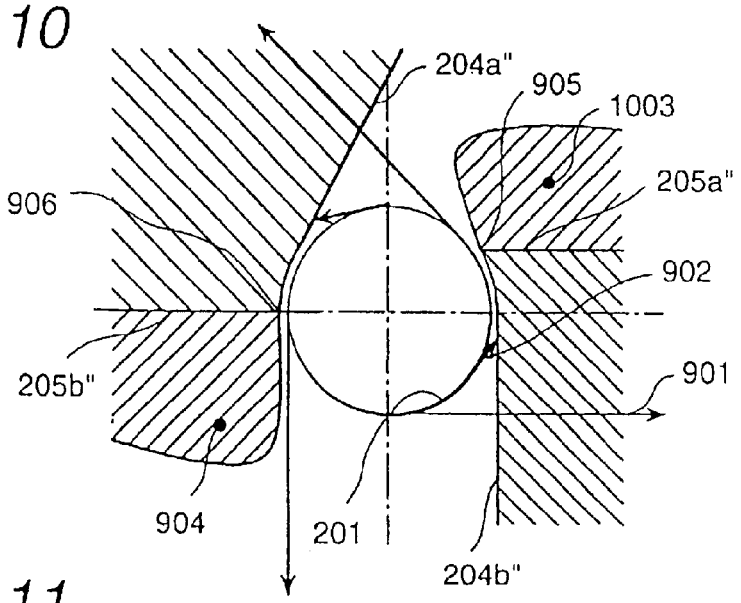
FIG. 10 is a diagrammatic view of the neighborhood of the injection hole in the fuel injector shown in FIG. 9.

FIG. 10 is a further enlarged view of the injection hole open end shown in FIG. 9(*b*), and this view also shows above-mentioned deposits 1003 and 904 which, with respect to the entire injection hole open end, are provided on only the recessed wall surfaces 205*b*" and 205*a*" at the upstream side with respect to the flow (rotational) direction of the fuel.

For the shape of the injection hole open end shown in FIG. 9(*b*), the angle at the corner 905 where the above-mentioned recessed wall surface 205*a*" at the upstream side and wall surface 204*b*" are connected, is acute, and the angle at the corner 906, where wall surface 205*b*" and wall surface 204*a*" are connected, is approximately perpendicular. Both the wall surface 205*a*" connected to corner 905 and wall surface 205*b*" connected to corner 906 are positioned at a location where they do not interfere with the injected fuel, and so deposits easily accumulate on these wall surfaces when the engine is operated. In the case of the injection hole open end shown in FIG. 3, wall surfaces 205*b* and 205*a* correspond to the wall surfaces 205*b*" and 205*a*", respectively, in FIG. 10. In the case of the injection hole open end shown in FIG. 3, if deposits stick to wall surfaces 205*b* and 205*a*, since these deposits will accumulate and grow in the approximately perpendicular direction of wall surfaces 205*b* and 205*a*, the deposits will easily interfere with the injected fuel. Therefore, by forming the corners between wall surfaces 205*b*" and 204*a*" and between wall surfaces 205*a*" and 204*b*" into either an approximately perpendicular or acute angle, as shown in FIG. 10, the deposits that accumulate on wall surfaces 205*b*" and 205*a*" can be prevented from easily interfering with the fuel that splashes, and as a result, changes in the spraying pattern due to the growth of deposits can be suppressed.

The shapes of the injection hole open ends shown in FIGS. 9(*a*), 9(*b*) and 10 are designed so that even if the shapes of these open ends are formed by plastic working, the desired spraying pattern can be obtained. For the shapes of the injection hole open ends shown in FIGS. 9(*a*), 9(*b*) and 10, wall surfaces 204*a*" and 204*b*" located downstream with respect to the flow (rotational) direction of the fuel are formed in an approximately tangential direction of the circumference of the injection hole inner wall 201, at the position closest to inner wall 201.

Wall surfaces 204*a*" and 204*b*" located downstream with respect to the rotational direction of the fuel in FIG. 10 correspond to the wall surfaces 204*a* and 204*b* in FIG. 3. As with wall surface 204*a*, however, it is not formed in an approximately tangential direction of the circumference of injection hole inner wall 201, at the position closest to inner wall 201, and has an angle.

In general, when an injection hole open end is formed by plastic working, since corners are not easy to work, it is easier to provide radial portions having a curvature. However, at wall surfaces, such as wall surface 204*a*, that affect the spraying pattern because of interference with the fuel that splashes, since the presence of radial portions changes the distance with respect to the fuel injection positions on the outer periphery of the injection hole inner wall 201, the degree of interference with the fuel that splashes differs according to the particular dimensions of the radial portions. For this reason, factors, such as dimensional differences associated with the manufacture of the radial portions, may cause the spray pattern to vary from fuel injector to fuel injector.

Hence, as shown in FIG. 10, by forming wall surfaces 204*a*" and 204*b*" in an approximately tangential direction of the circumference of injection hole inner wall 201, at the position closest to inner wall 201, it becomes unnecessary to provide corners at the wall surfaces that affect the spray pattern because of interference with the fuel that splashes, and it also becomes possible to obtain a fuel injector that is capable of creating the desired spray pattern, even when the injection hole open end is processed using a processing method, such as plastic working, that facilitates the manufacture of this open end by providing a curvature at each corner.

As set forth above, according to the present invention, a fuel injector that enables the flow rate of a sprayed fuel to be concentrated into approximately two directions by use of a relatively simple method and produces differences between the respective flow rate distributions, can be supplied by processing the injection hole open end of a swirl-type fuel injector equipped with a single injection hole, and then providing in the circumferential area of the open end of the injection hole a plurality of release areas different in size and in which the fuel can flow radially. The effectiveness described above can be achieved by changing the shape of the injection hole open end, and thus, since new parts do not need to be added, a fuel injector appropriate for the particular specifications of the in-cylinder injection engine can be supplied without any significant increase in costs.

According to the fuel injector pertaining to the present invention, an ideal spray pattern for the intended in-cylinder injection engine can be obtained.

What is claimed is:

1. A fuel injector comprising:

a valve body provided with a fuel injection hole and for opening and closing a fuel passageway between said injection hole and a valve seat provided at the upstream end of the injection hole, means for driving said valve body, means provided at an upstream end of the injection hole for generating a swirl flow to fuel passing through said injection hole; and restraint means for restraining the flow of a fuel, provided downstream with respect to the injection hole and outside said injection hole, wherein said restraint means restrains radial spreading of the swirled fuel passing through the injection hole in at least two places and splits the swirled fuel into portions high in spraying density of the injected swirled fuel and portions low in spraying density of the injected swirled fuel, in that the split portions of the fuel that are high in spraying density differ from each other in terms of quantity.

2. A fuel injector according to claim 1, wherein said fuel injector is characterized in that a wall surface for restraining the flow of the fuel in its radial direction is provided as said flow restraint means along, and downstream with respect to, the injection hole, in that a plurality of restraint areas for restraining the flow of the swirled fuel in its radial direction and a plurality of release areas for enabling the swirled fuel to flow in its radial direction are provided, and in that said release areas differ from each other in terms of size.

3. A fuel injector according to claim 1, wherein said fuel injector is characterized in that a plurality of wall surfaces almost parallel to the central axis of the injection hole for limiting the flow of the injected swirled fuel are provided as said flow restraint means, in that a plurality of limitation areas for limiting the flow of the swirled fuel in its radial direction and a plurality of release areas for enabling the swirled fuel to flow in its traveling direction are provided, and in that said release areas differ from each other in terms of size.

4. A fuel injector comprising:

a valve body provided with a fuel injection hole and for opening and closing a fuel passageway between said injection hole and a valve seat provided at the upstream end of the injection hole, means for driving said valve body, and means provided at an upstream end of the injection hole for generating a swirl flow to fuel passing through said injection hole; and wherein said fuel injector is characterized in that a wall surface is provided which restricts the radial spread of the swirled fuel passing through said injection hole, said wall surface being almost parallel to the central axis of the injection hole and provided downstream with respect to and at the marginal portions of the injection hole so that said wall surface is positioned outside, and at a required distance from, the inner wall of the injection hole, in that a plurality of circumferential areas around the inner wall of the injection hole are provided so that the distance from said wall surface to the inner wall of the injection hole is longer than the required distance, and in that said circumferential areas differ from each other in terms of size.

5. A fuel injector according to any one of claims 1 to 4, wherein said fuel injector is characterized in that, during the spraying of the fuel which has been injected from said injection hole, the density distribution of the sprayed fuel at a cross section vertical to the body axial line of the fuel injector concentrates in approximately two directions, and in that the spraying pattern of the fuel is set to ensure that the flow rate of the sprayed fuel in one of the two directions of concentration is greater than the flow rate of the fuel in the other direction.

6. A fuel injector according to any one of claims 2 to 4 above, wherein said fuel injector is characterized in that more than one wall surface parallel to the central axis of said injection hole is provided downstream with respect to the injection hole and in that at least one of said wall surfaces and the inner wall of the injection hole take an almost abutting-angle relationship at a position closest to said at least one wall surface.

7. A fuel injector according to claim 2, wherein said fuel injector is characterized in that more than one wall surface parallel to the central axis of said injection hole is provided downstream with respect to the injection hole and in that at least one of said wall surfaces is positioned so that the corresponding wall surface and the inner wall of the injection hole take an almost right-angle or acute-angle relationship at the position closest to that wall surface.

8. A fuel injector comprising:

a valve body provided with a fuel injection hole and for opening and closing a fuel passageway between said injection hole and a valve seat provided at the upstream end of the injection hole, a drive mechanism to drive said valve body, a fuel swirl generator provided at an upstream end of the injection hole to generate a swirl flow in fuel passing through said injection hole; and restraint walls to restrain the flow of a fuel, said restrain walls being provided downstream with respect to the injection hole and outside said injection hole, wherein said restraint walls restrain radial spread of the swirled fuel passing through the injection hole in at least two places and split the swirled fuel into portions high in spraying density of the injected swirled fuel and portions low in spraying density of the injected swirled fuel, wherein the split portions of the fuel that are high in spraying density differ from each other in terms of quantity.

9. A fuel injector according to claim 1, wherein said fuel injector further comprises a plurality of release areas to enable the swirled fuel to flow in its radial direction, wherein said release areas differ from each other in terms of size and are formed in areas between said restraint walls.

* * * * *